United States Patent [19]

Sato

[11] 4,206,704

[45] Jun. 10, 1980

[54] CONSTANT PRESSURE PRINTING MECHANISM FOR PORTABLE LABEL PRINTING MACHINE OR THE LIKE

[75] Inventor: Yo Sato, Tokyo, Japan

[73] Assignee: Kabushiki Kaisha Sato Kenkyusho, Tokyo, Japan

[21] Appl. No.: 909,431

[22] Filed: May 25, 1978

[30] Foreign Application Priority Data

May 27, 1977 [JP] Japan ..... 52/061220

[51] Int. Cl.[2] ..... B41J 5/00

[52] U.S. Cl. ..... 101/291; 101/298; 101/288; 400/652; 400/437; 156/384

[58] Field of Search ..... 156/384; 101/287, 288, 101/291, 292, 93.02, 316, 297, 93.03, 298, 10, 20; 400/157, 3, 166, 167, 388, 388.1, 389, 397, 424, 428, 435, 437, 440.2, 648, 649, 652, 686, 687; 267/158; 227/132; 74/97, 2; 173/118, 120, 139; 251/75, 251, 262, 263, 76, 77, 78, 80

[56] References Cited

U.S. PATENT DOCUMENTS

| | | | |
|---|---|---|---|
| 2,073,902 | 3/1937 | Olivetti | 400/452 |
| 2,342,898 | 2/1944 | Sand, Jr. | 101/297 |
| 2,519,477 | 8/1950 | Kind | 173/118 |
| 4,072,105 | 2/1978 | Becker et al. | 101/288 |
| 4,125,419 | 11/1978 | Hamisch, Jr. | 101/291 |

*Primary Examiner*—William Pieprz

*Attorney, Agent, or Firm*—Ostrolenk, Faber, Gerb & Soffen

[57] ABSTRACT

A constant pressure printing mechanism for use in a portable label printing machine, or the like: a pressing member is attached to a hand operated driving lever which carries the printing head and which is pivotally attached to the machine frame; a separate rocking lever is pivotally attached to the machine frame; a pressure receiving member attached to the rocking lever is in position to be engaged by the pressure member as the driving lever pivots; continued pivoting of the driving lever causes subsequent separation of the pressure receiving and pressure members, thereby again freeing the rocking member from being pivoted; a platen pivotally secured to the machine frame is normally biased away from the printing head; an elastic buffer member is stretched between the rocking lever and the platen for pivoting the platen toward the printing head when the rocking member is pivoted by the pressure member; with the provision of the constant pressure printing mechanism of the invention, the intensity and the contact time in printing can be regularized irrespective of the intensity and the time length of the squeezing of hand lever, thereby attaining clear and precise printing of uniform darkness without causing double printing and blurring of ink.

19 Claims, 4 Drawing Figures

CONSTANT PRESSURE PRINTING MECHANISM FOR PORTABLE LABEL PRINTING MACHINE OR THE LIKE

BACKGROUND OF THE INVENTION

1. Field of the Invention

This invention relates to a constant pressure printing mechanism for use in a portable label printing machine, or the like.

2. Description of the Prior Art

In conventional hand-held label printing machines, the hand operated lever is a driving lever. The printing lever, which carries a printing head, is generally integral with the driving lever. The driving lever is pivotally secured to the machine body. When the hand lever is squeezed, the printing head is moved down together with the printing lever until the type faces of the printing head are brought into contact with a label which is supported on a fixed platen.

The intensity of squeezing of the hand lever directly influences the printing pressure. Uneven squeezing force is liable to cause uneven darkness of the printed characters. Further, when the hand lever is squeezed strongly and quickly, the printing head strikes the platen hard and it bounces on the platen to cause double printing.

Previously, even when labels were printed somewhat indistinctly, they were generally accepted because they could be read with the naked eye when customers bought commodities or cashiers totalized sales accounts.

In recent years, however, what is called POS (point of sales) system has been employed throughout the world. In this system, the numerals, characters and symbols, such as bar codes and optically readable characters that are printed on labels, are automatically read out by means of optical character readers instead of the eyes of cashiers. These optical character readers memorize and calculate several management data such as stocks, sales, materials for customers in relation to commodities, and profit accounts. To be read by optical character readers, the labels must be printed clearly and precisely.

SUMMARY OF THE INVENTION

It is the principal object of the present invention to provide a constant pressure printing mechanism for a portable label printing machine, or the like, in which the printing pressure and the contact time for a label imprinting are regularized, irrespective of the intensity and duration of the hand lever squeezing.

It is another object of the present invention to provide a constant pressure printing mechanism in which the printing head and the platen are separated immediately after the printing stroke so as to prevent the occurrence of double printing by eliminating the shock and bouncing in the printing stroke.

A further object of the present invention is to provide such a constant pressure printing mechanism in which both the printing head and the platen move toward each other.

Still a further object of the present invention is to provide a constant pressure printing mechanism which is simple in structure, and is easily produced at low cost and which may be used for a long time without trouble.

In accordance with the present invention, the constant pressure printing mechanism comprises a hand operated driving lever which is pivotally attached to the machine frame. The driving lever carries the printing head. A pressure member is pivotally secured to the hand operated driving lever and moves therewith. A rocking lever is pivotally secured to the machine frame. A pressure receiving member is attached to the rocking lever and is engaged by the pressure member as the driving lever pivots.

A platen is pivotally secured to the machine frame. An elastic return means always urges the platen to pivot in the direction away from the printing head. An elastic buffer means is stretched between the rocking lever and the platen, whereby pivoting of the rocking lever under the influence of the pressure member pivots the platen toward the printing head under the urging of the buffer means.

When the driving lever is actuated by squeezing of the hand lever, the pressure member is brought into contact with the pressure receiving member which pivots the rocking lever and, through the buffer means, raises the platen. The printing head is at the same time being moved to the platen and their engagement prints a label. After an imprinting, the rocking lever and the platen are returned to their released positions by the pressure member and the pressure receiving member passing across each other.

In an embodiment of the constant pressure printing mechanism of the present invention, the pressure member, rocking lever, pressure receiving member, elastic buffer member and elastic return member are all provided in pairs, respectively, so as to facilitate smooth operation.

According to further aspect of the present invention, the pressure member comprises an L-shaped lever and a pressure roller which is pivotally secured to one end of the lever, and the pressure receiving member comprises a roller which is also pivotally secured to one end of the rocking lever.

BRIEF DESCRIPTION OF THE DRAWINGS

Other objects and features of the present invention will be apparent to those skilled in the art from the following detailed description of a preferred embodiment of the present invention with reference to the accompanying drawings, in which.

DESCRIPTION OF A PREFERRED EMBODIMENT

Figure 1:
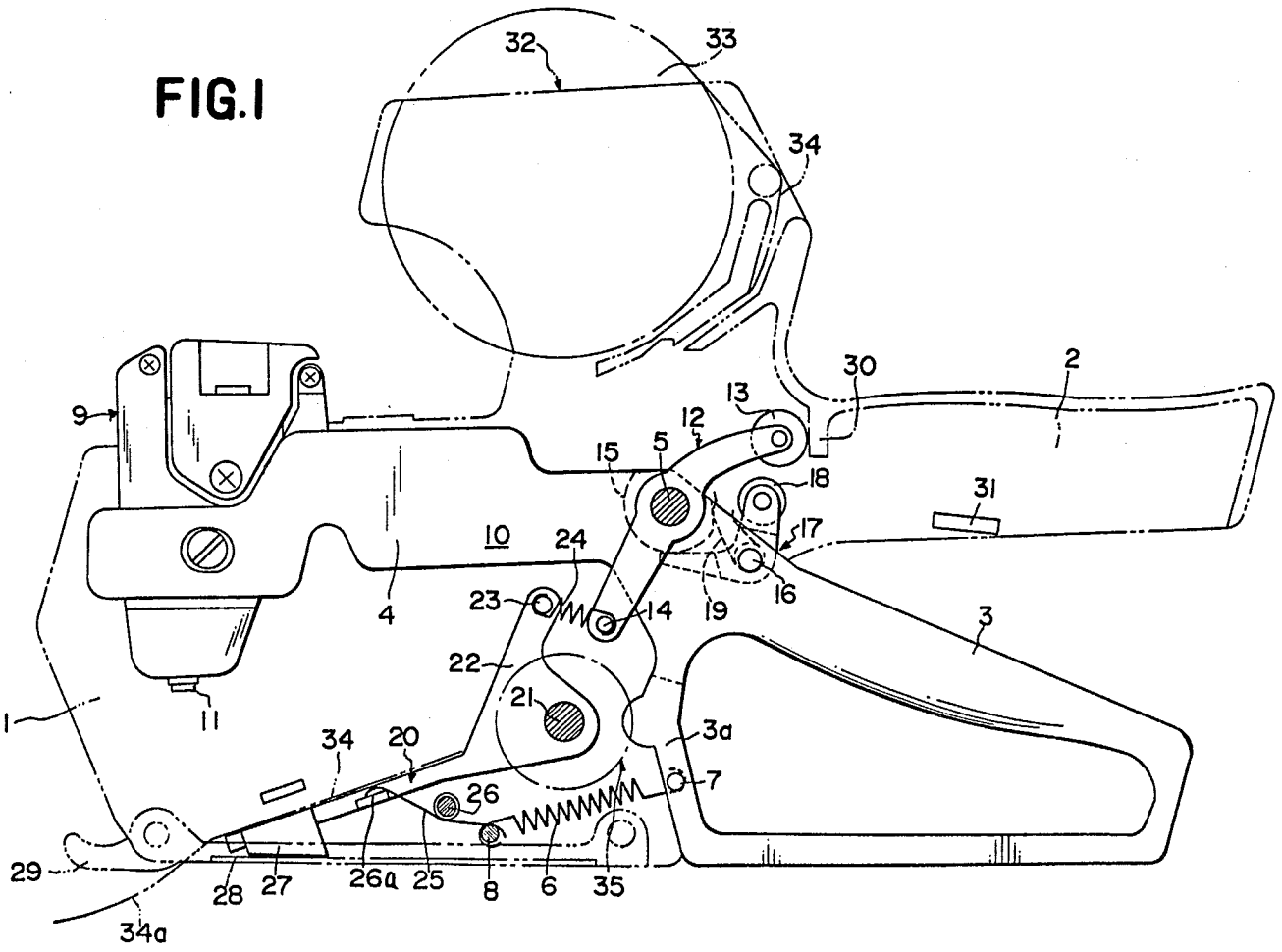
FIG. 1 is a partially cross-sectional, side elevational view of a portable label printing machine, which is provided with an embodiment of the constant pressure printing mechanism of the present invention shown in the rest position, and in which the machine frame on the near side is removed.

The label printing machine shown in FIG. 1, has opposed, spaced apart machine frames 1. At the rear (right side on FIG. 1) of the machine frames 1, a hand grip 2 is integrally formed. Between the machine frames 1, a driving lever 10 is pivotally secured to the frames 1 by a pivot shaft 5. The driving lever 10 is comprised of a hand lever 3 which extends toward the rear of the machine frame and bifurcated printing arms 4 which are integrally formed with and extend forward from the hand lever 3.

A pair of return springs 6 are stretched between the spring pins 7 which are formed on the front frames 3*a* of the hand lever 3 and spring pins 8 which are formed on the inside walls of the machine frames 1. The return springs 6 bias both the hand lever 3 and the printing levers 4 in the clockwise direction.

Between the free forward end portions of the printing levers 4, there is a printing head 9. The printing head 9 is provided with a series of types 11 on its bottom side.

To the pivot shaft 5 on both lateral sides of the driving lever 10, a pair of rocking levers 12 are pivotally secured approximately at their middle portions. Each rocking lever 12 has a rotatable pressure receiving roller 13 at its upper end and a spring pin 14 at its lower end. A connecting section 15 is formed between the printing arms 4 and the pivot shaft 5 is inserted into the connecting section 15.

Further, to the rear (or right) of the connecting section 15, a pin 16 is attached between the wall portions of the hand lever 3. A generally L-shaped pressure member 17 is pivotally secured to the pin 16. The upper end of the vertical arm of the pressure member 17 is provided with a pressure roller 18. The upper side of the other arm of the pressure member 17 is brought into contact with the underside of the connecting member 15. The pressure member 17 is always urged clockwise by a spring 19, which is fitted to the pin 16.

A pivot shaft 21 is attached between the machine frames 1. Shaft 21 pivotally carries a platen 20. The platen is provided with a pair of side plates 22. Between spring pins 23, which are formed at the top of and on the outsides of the platen side walls 22, and other spring pins 14, which are formed on the lower ends of the rocking levers 12, tensioned buffer springs 24 are stretched. A pair of return springs 25 are fitted on the pins 26 that are formed on the inside walls of the machine frames 1. One end of each spring 25 engages the spring pin 8 on a frame 1 and the other end of each spring 25 engages an engaging lug 26*a* on the platen. The whole platen 20 is urged counterclockwise by the spring 25 about pivot shaft 21. Since the force of the return springs 25 is larger than the force of the buffer springs 24, the undersides of the front side plates 27 of the platen 20 are brought into contact with the bottom plate 28 of the machine body, in the rest position of the labeling machine in which the hand lever 3 is not squeezed.

The stoppers 30 and 31 are formed within the hand grip 2. The stopper 30 is brought into contact with the pressure receiving roller 13 of the rocking lever 12. The other stopper 31 comes into contact with the upper surface of the hand lever 3 when lever 3 is squeezed during the operation of the label printing machine.

A label holder 32 supports a rolled label strip 33. The tape-like label strip 34 which is supplied from the rolled label strip 33 is fed onto the platen 20 by means of a known feeding mechanism 35 that is disposed under the label holder 32.

The operation of the constant pressure printing mechanism of the present invention is now described. Although some parts are provided in pairs, only one of them on one side is described with reference to the accompanying drawings.

FIG. 1 shows the rest position of the label printing machine. The under edge of the front side plate 27 of the platen 20 is held in contact with the bottom cover 28 of the machine body by the force of the return spring 25. At the same time, the rocking lever 12 is pulled clockwise about the pivot shaft 5 by the force of the tensioned buffer spring 24. The pressure receiving roller 13 is stopped as its external surface is caught by the stopper 30 that is formed in the hand grip 2.

Figure 2:
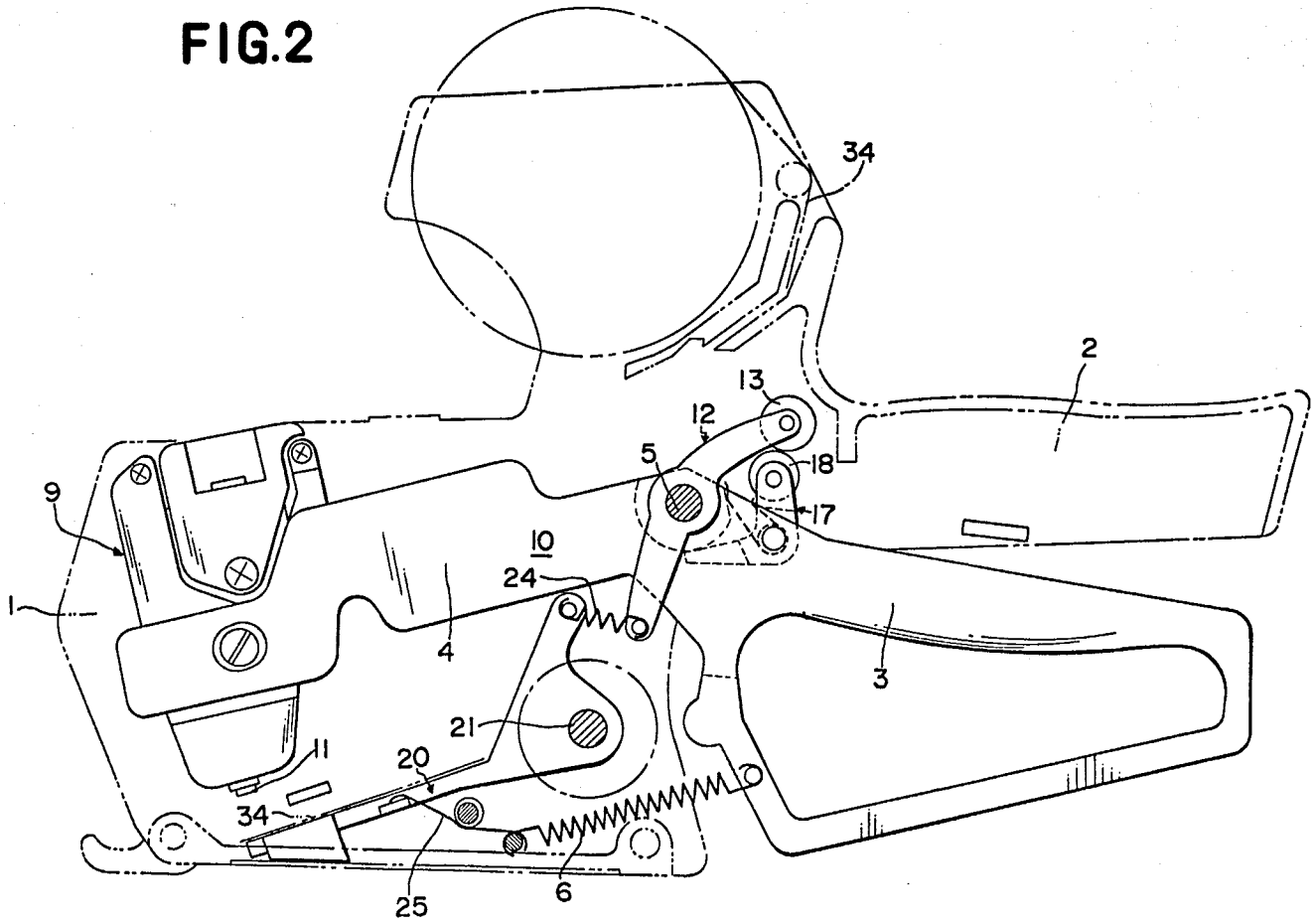
FIG. 2 is the same view, in which the hand lever has been squeezed halfway.

When the hand grip 2 and the hand lever 3 are squeezed together, and the lever 3 turns upward (counterclockwise), as shown in FIG. 2, the printing lever 4 that is integral with the hand lever 3 also turns downward (counterclockwise) about the pivot shaft 5. This moves the printing head 9 down. In this operation, an inking roller (not shown) rolls over the surfaces of types 11 of the printing head 9 to apply ink to the types 11.

The pressure roller 18 of the pressure member 17 is brought into contact with the undersurface of the pressure receiving roller 13 to lift roller 13 upward. The rocking lever 12 is thereby turned slightly counterclockwise about the fulcrum of the pivot shaft 5 against the force of the buffer spring 24. In the condition of FIG. 2, the platen 20 remains down since the force of the platen return spring 25 is yet larger than that of the buffer spring 24.

Figure 3:
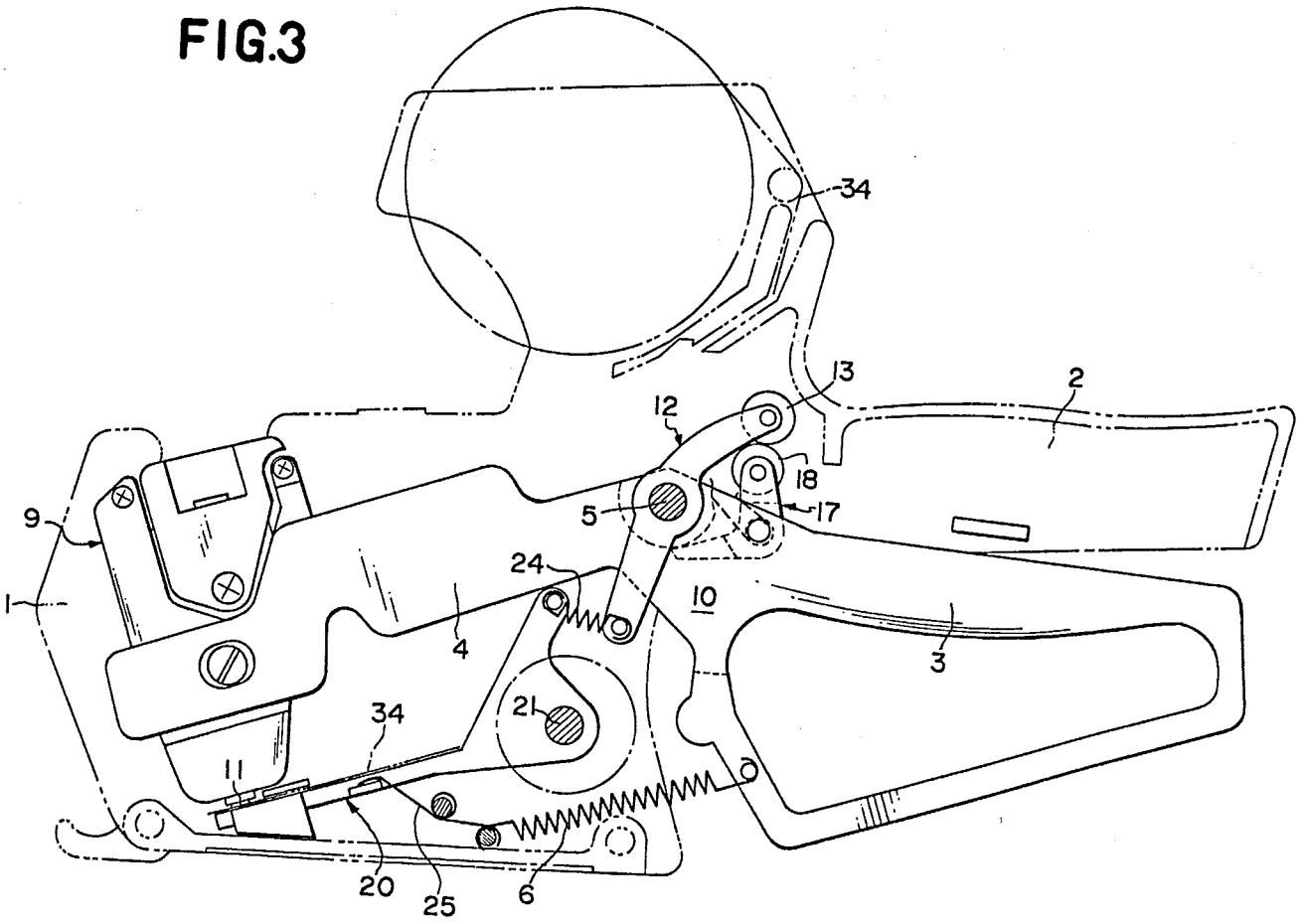
FIG. 3 is the same view, with the mechanism in the printing position.

When the hand lever 3 is further squeezed, the rocking lever 12 is further turned counterclockwise by the pressure roller 18. This motion increases the force of the buffer spring 24 until that force becomes larger than that of the return spring 25. Then the platen 20 is turned clockwise about the fulcrum of pivot shaft 21, as shown in FIG. 3, and the tape-like label strip 34 carried on the platen 20 is raised together with the platen 20. Thus, the label strip 34 is brought into contact with the faces of types 11 of the printing head 9, which is simultaneously being lowered by the printing lever 4, thereby printing the label.

Figure 4:
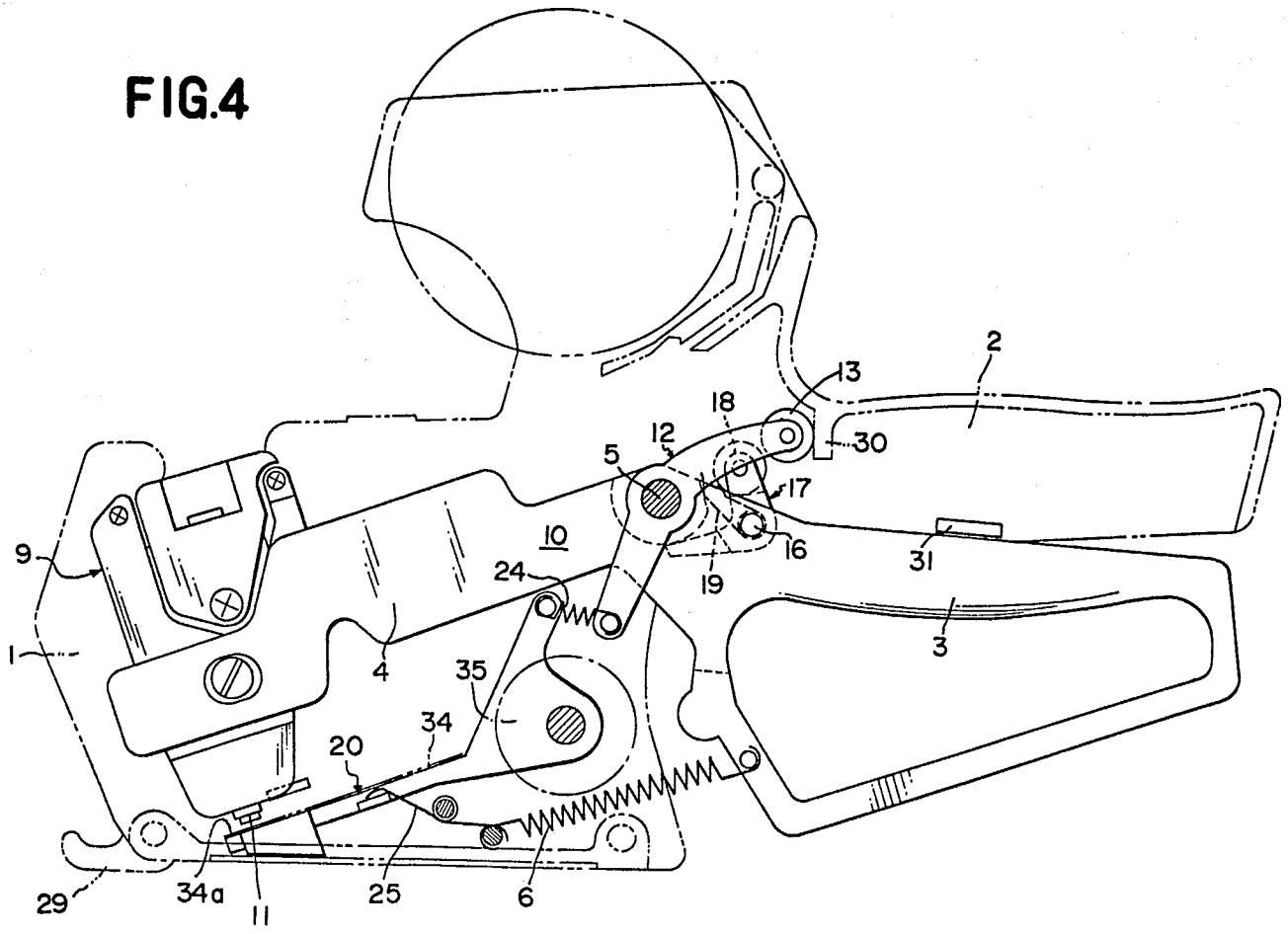
FIG. 4 is the same view, in which the hand lever is fully squeezed.

When the hand lever 3 is squeezed further, the pressing roller 18 moves across the pressure receiving roller 13 by overcoming the resistance of the buffer spring 24 and the roller 18 comes in front of the pressure receiving roller 13, as shown in FIG. 4. The rocking lever 12 is again freed and turns clockwise under the urging of the buffer spring 24 until the pressure receiving roller 13 is again stopped by the stopper 30. At the same time, the platen 20 is returned counterclockwise into the original position by the force of the return spring 25 so that the surface of the label is separated from the faces of types 11.

In the next step, when the hand lever 3 is released, the hand lever 3 and the printing lever 4 are turned about the fulcrum of the pivot shaft 5 by the return spring 6 and the printing head 9 is raised. The pressure roller 18 of the pressure member 17 is moved backward through its contact with the pressure receiving roller 13. In this case, the pressure member 17 is turned about the pin 16 in the clockwise direction by the force of the spring 19 and the pressure roller 18 is passed across the pressure receiving roller 13. In contrast with the squeezing operation of the driving lever 10, the lever 10 can be smoothly turned into the rest position shown in FIG. 1 without large resistance.

Simultaneously with the above action, the tape-like label strip 34 is shifted forward by the length of one label by the feeding mechanism 35 and the printed label 34*a* is fed out under the applicator 29.

Note further that the constant pressure printing mechanism of the present invention can be applied not only to the above-described label printing machine but also to price tag attaching machines, desk-type label printing machines, or the like.

The above-described constant pressure printing mechanism has a number of advantages.

(1) Since the platen is interlocked with the squeezing operation of the hand lever and both the type faces of the printing head and the label surface on the platen are moved to approach to each other so as to print labels, the printing pressure between the type faces and the label surface is always almost constant, and thin or irregular printing can be avoided.

(2) Since a buffer spring is interposed between the platen and the rocking lever and the rocking lever is interlocked with the squeezing operation of the hand lever, the squeezing force applied to the hand lever is transmitted indirectly as printing pressure which is moderated by the buffer spring. Therefore, even when the hand lever is squeezed too strongly, excessive printing pressure and too dark printing can be prevented.

(3) Further, immediately after the printing stroke, the pressure member and the pressure receiving member pass across each other and the printing state is discontinued by the return of the rocking lever and the platen into their original positions. This protects the label surface from being subjected to the influence of unnecessary force of squeezing after the printing. In addition, the contact time of printing is made uniform. In view of these points, the darkness of printing can be regularized and blurring of the ink can be avoided.

(4) Furthermore, since the platen is not fixed and the printing is done by turning the platen under the force of the buffer spring, the shock of the printing stroke can be moderated and absorbed by the buffer spring. As the result, bouncing of the type faces on the platen surface is avoided and double printing can be eliminated.

(5) Both the printing pressure and the printing time can be regularized so that label printing of constant darkness can be attained without the occurrence of double printing and clearly printed labels can always be obtained.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A printing machine for labels, or the like, comprising:

a driving lever; a printing head carrying printing types and connected with said driving lever for being moved by said driving lever between a printing head printing position, at which a label on a platen is printed by said types, and a printing head released position;

a platen positioned in opposition to said types and being movable from a platen released position to a platen printing position; with said platen at said platen printing position, said types of said printing head being against a label on said platen when said printing head is at said printing head printing position; biasing means normally biasing said platen to said platen released position;

a pressure member attached to said driving lever and movable therewith;

a rocking lever, which is supported for motion between a rocking lever released position and a rocking lever actuated position; said rocking lever having a pressure receiving member thereon adapted to be engaged by said pressure member, and upon such engagement, said pressure member moving said rocking lever to said rocking lever actuated position;

an elastic buffer connected between said rocking lever and said platen for moving said platen, against the bias of said biasing means, to said platen printing position as said rocking lever moves to said rocking lever actuated position;

said pressure member and said pressure receiving member being respectively shaped and positioned such that after engagement between said pressure member and said pressure receiving member and after the movement of said driving lever has moved said platen to said platen printing position and has moved said printing head to said printing head printing position, said pressure member and said pressure receiving member being caused to separate, thereby freeing said rocking lever to return to said rocking lever released position and freeing said platen to be returned by said biasing means to said platen released position.

2. The printing machine of claim 1, further comprising a return spring for returning said driving lever toward said position thereof for said printing head to be in said printing head released position.

3. The printing machine of claim 1, wherein with said rocking lever in said released position thereof, said biasing means being adapted to exert greater biasing force on said platen than said elastic buffer, whereby said platen remains in said platen released position; with said rocking lever approaching said actuated position thereof, said elastic buffer being adapted to exert greater biasing force on said platen than said biasing means, whereby said platen is moved to said platen printing position.

4. The printing machine of claim 1, wherein said machine comprises a frame and said platen is pivotally supported on said frame to pivot between its said positions.

5. The printing machine of claim 1, wherein said machine comprises a frame and said rocking lever is pivotally supported on said frame to pivot between its said positions.

6. The printing machine of claim 5, wherein said driving lever is pivotally attached to said frame and said printing head is attached to said driving lever to move therewith.

7. The printing machine of claim 5, wherein said pressure member is attached to said driving lever at one side of said pivot connection of said driving lever to said frame and said printing head is attached to said driving lever at the other side of that said pivot connection.

8. The printing machine of claim 7, wherein said machine comprises a frame and said platen is pivotally supported on said frame to pivot between its said positions.

9. The printing machine of claim 8, further comprising a return spring for returning said driving lever toward said position thereof for said printing head to be in said printing head released position.

10. The printing machine of claim 9, wherein with said rocking lever in said released position thereof, said biasing means being adapted to exert greater biasing force on said platen than said elastic buffer, whereby said platen remains in said platen released position; with said rocking lever approaching said actuated position thereof, said elastic buffer being adapted to exert greater biasing force on said platen than said biasing means, whereby said platen is moved to said platen printing position.

11. The printing machine of claim 5, wherein said platen is pivotally supported on said frame to pivot between its said position; said platen is pivotally supported to said frame at a different location than said rocking lever is pivotally supported on said frame.

12. The printing machine of claim 11, wherein said driving lever is pivotally attached to said frame and said printing head is attached to said driving lever to move therewith.

13. The printing machine of claim 12, wherein said rocking lever in said released position thereof, said biasing means being adapted to exert greater biasing force on said platen than said elastic buffer, whereby said platen remains in said platen released position; with said rocking lever approaching said actuated position thereof, said elastic buffer being adapted to exert greater biasing force on said platen than said biasing means, whereby said platen is moved to said platen printing position.

14. The printing machine of claim 13, further comprising a return spring for returning said driving lever toward said position thereof for said printing head to be in said printing head released position.

15. The printing machine of claim 14, wherein said pressure member is pivotally secured to said driving lever.

16. The printing machine of claim 15, wherein said pressure member has two legs extending away from its said pivot connection to said driving lever; one said leg carrying a pressing member which is placed to engage said pressure receiving member; the other said leg being positioned to engage said frame after certain motion of said driving lever for moving said printing head to said printing head printing position, such that further motion of said driving lever in the same direction which moves the printing head to said printing head printing position thereafter pivots said pressing member away from said pressure receiving member, thereby disengaging said pressure member and said pressure receiving member.

17. The printing machine of claim 16, wherein said pressure member is L-shaped and the portion of said frame engaged by said pressure member comprises a pivot mount on said frame for said rocking lever.

18. The printing machine of claim 16, wherein said pressure member is attached to said driving lever at one side of said pivot connection of said driving lever to said frame and said printing head is attached to said driving lever at the other side of that said pivot connection.

19. The printing machine of claim 16, wherein said rocking lever in said released position thereof, said biasing means being adapted to exert greater biasing force on said platen than said elastic buffer, whereby said platen remains in said platen released position; with said rocking lever approaching said actuated position thereof, said elastic buffer being adapted to exert greater biasing force on said platen than said biasing means, whereby said platen is moved to said platen printing position.

* * * * *